United States Patent [19]

Hayashi

[11] Patent Number: 4,470,376

[45] Date of Patent: Sep. 11, 1984

[54] CYLINDER BLOCK OF ENGINE

[75] Inventor: Yoshimasa Hayashi, Kamakura, Japan

[73] Assignee: Nissan Motor Company, Limited, Yokohama, Japan

[21] Appl. No.: 386,033

[22] Filed: Jun. 7, 1982

[30] Foreign Application Priority Data

Jun. 11, 1981 [JP] Japan ..... 56-84938[U]

[51] Int. Cl.[3] ..... F02F 1/10

[52] U.S. Cl. ..... 123/41.74; 123/195 R

[58] Field of Search ..... 123/41.72, 41.74, 41.81, 123/41.83, 195 R

[56] References Cited

U.S. PATENT DOCUMENTS

| | | | |
|---|---|---|---|
| 1,720,510 | 7/1929 | Chorlton | 123/41.83 |
| 3,064,633 | 11/1962 | Seifert et al. | 123/41.72 |
| 3,173,407 | 3/1965 | Sampietro et al. | 123/195 R |
| 3,528,397 | 9/1970 | Seifert | 123/41.72 |
| 4,184,462 | 1/1980 | Hale | 123/55 VS |
| 4,237,847 | 12/1980 | Baugh et al. | 123/41.72 |

FOREIGN PATENT DOCUMENTS

| | | | |
|---|---|---|---|
| 1009008 | 5/1952 | France . | |
| 2129600 | 10/1972 | France . | |
| 53-158545 | 2/1978 | Japan | 123/41.79 |
| 464604 | 12/1968 | Switzerland . | |

*Primary Examiner*—William A. Cuchlinski, Jr.

*Attorney, Agent, or Firm*—Schwartz, Jeffery, Schwaab, Mack, Blumenthal & Koch

[57] ABSTRACT

A cylinder block comprises a cylinder-barrel structure having a plurality of cylinder barrels; a water jacket outer wall structure disposed spaced from the cylinder-barrel structure to define therebetween a water jacket, the outer wall structure being fully spaced from said cylinder-barrel structure at the top surface of the cylinder block onto which top surface a cylinder head is to be secured, the outer wall structure including first and second side wall sections which are located opposite so as to interpose therebetween the cylinder-barrel structure; and a reinforcement member disposed to rigidly connect the first and second side wall sections in a manner to traverse said cylinder-barrel structure, thereby suppressing the vibration of the water jacket outer wall structure thus preventing noise emission therefrom.

11 Claims, 5 Drawing Figures

CYLINDER BLOCK OF ENGINE

BACKGROUND OF THE INVENTION

1. Field of the Invention

This invention relates to a cylinder block of an internal combustion engine, and more particularly to an improvement in a cylinder block of the so-called open-deck type wherein a water jacket fully opens through the cylinder block top surface onto which a cylinder head is secured.

2. Description of the Prior Art

In connection with so-called open-deck type cylinder blocks, a water jacket outer wall is fully spaced from a cylinder-barrel structure at the cylinder block top surface onto which a cylinder head is secured, while the water jacket outer wall is securely connected at a lower block deck with the cylinder-barrel structure. Accordingly, the water jacket outer wall is not rigidly supported at the cylinder head top surface, so that the water jacket outer wall tends to readily vibrate, thereby emitting noise therefrom.

BRIEF SUMMARY OF THE INVENTION

In accordance with the present invention, a cylinder block comprises a cylinder-barrel structure having a plurality of cylinder barrels. A water jacket outer wall structure is disposed spaced from the cylinder barrel structure to define therebetween a water jacket. The water jacket outer wall structure being fully spaced from the cylinder-barrel structure at the top surface of the cylinder block onto which top surface a cylinder head is to be secured. The water jacket outer wall structure includes first and second side wall sections which are located opposite each other so as to interpose therebetween said cylinder-barrel structure. Additionally, a reinforcement member is disposed to rigidly connect first and second side wall sections of the water jacket outer wall structure in a manner to traverse the cylinder-barrel structure in which a part of the reinforcement member is secured to said cylinder-barrel structure. In the thus arranged engine, by virtue of the reinforcement member, the water jacket outer wall structure is greatly improved in rigidity while improving the torsional rigidity of the entire cylinder block. This greatly contributes to engine noise reduction and guards a head gasket from damage and breakage.

BRIEF DESCRIPTION OF THE DRAWINGS

The features and advantages of the cylinder block according to the present invention will be more clearly appreciated from the following description taken in conjunction with the accompanying drawing in which like reference numerals designate like parts and elements, and in which.

DETAILED DESCRIPTION OF THE INVENTION

Figure 1:
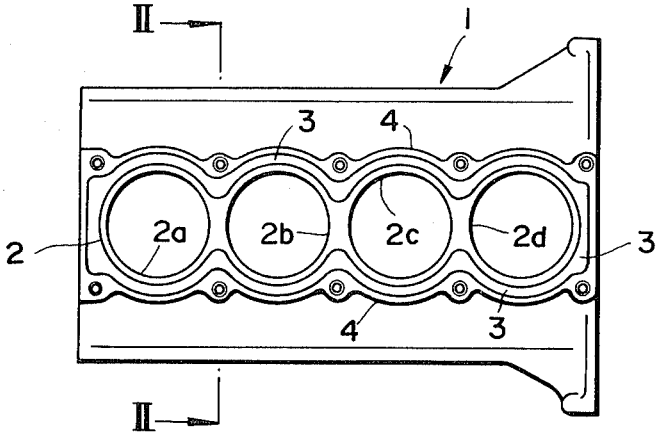
FIG.1 PRIOR ART
FIG. 1 is a plan view of a conventional open-deck type cylinder block.
Figure 2:
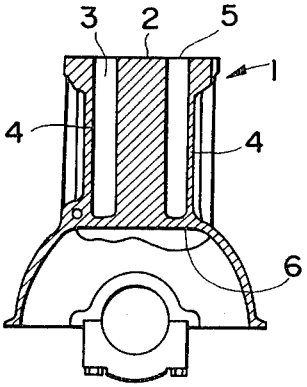
FIG.2 PRIOR ART
FIG. 2 is a vertical section view taken in the direction of arrows substantially along the line II—II.

Referring to FIGS. 1 and 2, a conventional cylinder block 1 will be described along with its major shortcomings. This conventional cylinder block 1 includes a cylinder-barrel structure 2 which is constructed of a row of cylinder barrels **2*a*–2*d* which are integrally connected with each other side-by-side. A water jacket 3 is formed around the cylinder barrel structure 2. A water jacket outer wall 4 located outside of the water jacket 3 is separate from the cylinder-barrel structure 2 at an upper block deck 5 onto which a cylinder head (not shown) is securely mounted; but is integrally connected to the cylinder barrel structure 2 at a section in the vicinity of a lower block deck 6. In such a cylinder block configuration, the water jacket 3 opens at or through the upper block deck 5**, and therefore the thus arranged cylinder block is referred to as "an open-deck type cylinder block".

The cylinder block of this type has been employed for the reason that the water jacket 3 can be readily formed by drawing out a metal die corresponding to the water jacket after casting. However, in such an open-deck type cylinder block, the water jacket outer wall 4 around the water jacket 3 is rigidly supported at the section in the vicinity of the lower block deck 6 but not supported at the upper block deck 5, and therefore the water jacket outer wall 4 tends to readily vibrate. This not only generates noise but also breaks down the head gasket (not shown) interposed between the upper block deck 5 and the cylinder head, thereby allowing the leakage of coolant and combustion gas.

Figure 3:
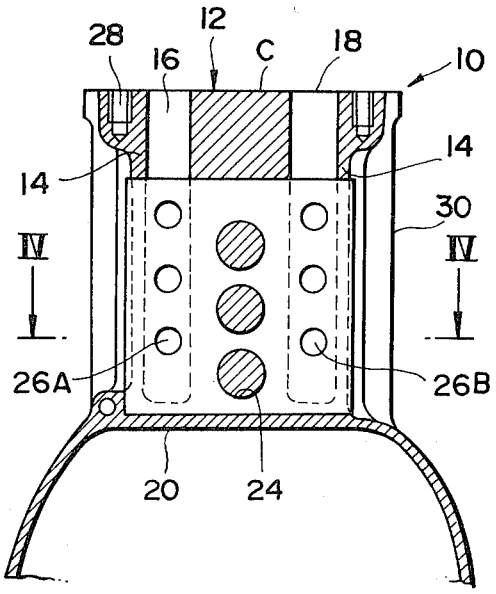
FIG. 3 is a vertical section view of a preferred embodiment of a cylinder block in accordance with the present invention.
Figure 4:
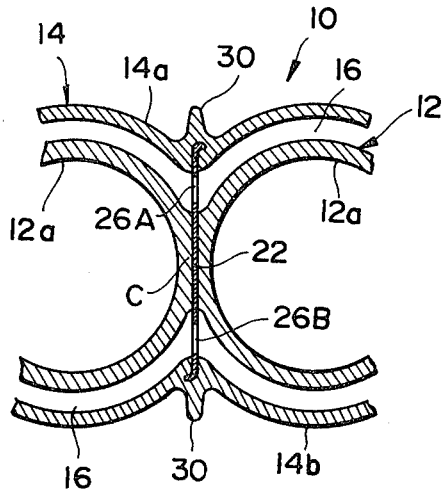
FIG. 4 is a fragmentary transverse section view taken in the direction of arrows substantially along the line IV—IV of FIG. 3.
Figure 5:
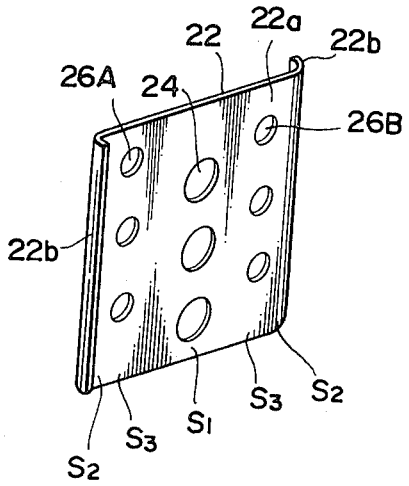
FIG. 5 is a perspective view of a reinforcement plate member used in the cylinder block of FIG. 3.

In view of the above description of the conventional cylinder block arrangement, reference is now made to FIGS. 3, 4 and 5, wherein a preferred embodiment of a cylinder block of the present invention is illustrated by the reference numeral 10. The cylinder block 10 is, in this instance, of an automotive internal combustion engine and comprises a cylinder-barrel structure 12 which is constructed of a row of aligned cylinder barrels **12*a* which are integrally connected with each other side-by-side, at connecting sections C through which the neighboring cylinder barrels 12*a*, 12*b* are integral with each other as clearly shown in FIG. 4. A water jacket outer wall structure 14 is formed around the cylinder-barrel structure 12 but is located spaced from the cylinder-barrel structure 12 to define therebetween a water jacket 16. The water jacket outer wall structure 14 is separate or spaced from the cylinder-barrel structure 12 at a so-called upper block 18 onto which a cylinder head (not shown) is rigidly mounted, so that the water jacket 16 opens through the upper block deck 18. In this regard, this cylinder block 10 is of the open-deck type. It will be understood that the water jacket outer wall structure 14 is integrally connected to the cylinder-barrel structure 12 at a section in the vicinity of a so-called lower block deck 20. The water jacket outer wall structure 14 includes opposite side wall sections 14*a*, 14*b* between which the cylinder barrel structure 12** is located.

As shown, a reinforcement plate member 22 is disposed at each connecting section C in a manner to traverse the cylinder-barrel structure 12 and the opposite sections of the water jacket 16 to be connected to the opposite side wall sections **14*a*, 14*b* of the water jacket outer wall structure 14. The reinforcement plate member 22 is, in this instance, formed of steel plate and in generally of the rectangular shape. The reinforcement plate member 22 includes a flat main body 22***a* of the rectangular shape. The main body 22*a* is provided at its opposite vertical end portions with two flanges or bent portions 22*a*, 22*b* which have been already formed by bending, in the opposite directions, the two opposite vertical end edges of the plate member 22 in the flat state. The reinforcement plate member 22 is so located that its main body section 22*a* is perpendicular to an imaginary vertical plane containing the axes of cylinder barrels 12*a*. In this connection, the reinforcement plate member 22 is formed with a row of relatively large diameter circular openings 24 which are aligned along the center vertical line (not shown) of reinforcement plate member 22. The reinforcement plate member 22 is further formed with two rows of relatively small diameter circular openings 26A, 26B which two rows are positioned parallel with and opposite to each other with respect to the row of the relatively large diameter openings 24, so that the row of the openings 26A is positioned between the flange portion 22*b* and the row of openings 24 while the row of openings 26B is positioned between the other flange section 22*b* and the row of openings 24.

More specifically, the reinforcement plate member 22 has a vertically elongate central section $S_1$ which is located and embedded in the connecting section C of the cylinder-barrel structure 12. The reinforcement plate member 22 further has vertically elongate opposite end sections $S_2$ which are respectively located and embedded in the opposite side wall sections 14*a*, 14*b* of the cylinder-barrel structure 14. Additionally, vertically elongate two medium sections $S_3$ are positioned between the central section $S_1$ and the end sections $S_2$ and located in the water jacket 16. In this connection, the row of openings 24 are positioned at the central section $S_1$; the row of openings 26A are positioned at one of the medium sections $S_3$ while the other row of openings 26B are positioned at the other of the medium sections $S_3$; and the two flange sections 22*b* are positioned respectively at the end sections $S_2$.

As will be understood from the above and FIGS. 3 and 4, the reinforcement plate member 22 is so disposed in the cylinder block 10 that the rows of openings 26A, 26B are located in the water jackets 16 so that a coolant passage is formed through the reinforcement plate member, and the row of openings 24 are located in the connecting section C of the cylinder-barrel structure 12 so that the openings 24 are filled with the material of the cylinder block 1, for example, aluminum alloy. In addition to this, the flange sections 22*b* formed at the opposite end parts are disposed or embedded in the opposite side wall sections 14*a*, 14*b* of the water jacket outer wall structure 14. The reference numeral 28 denotes bolt holes for head bolts (not shown) for securing the cylinder head onto the cylinder block 10. The reference numeral 30 denotes reinforcement ribs formed at the outer surface of the side wall sections 14*a*, 14*b* of the water jacket outer wall structure 14.

While only one reinforcement plate member 22 has been shown and described, it will be understood that a plurality of the reinforcement plate members 22 are used at similar positions and in similar manner as shown in FIGS. 3 and 4. It will be appreciated in this embodiment, that by suitably selecting the diameter and the number of the above-mentioned openings 24, 26A, 26B, the flow amount of engine coolant can be controlled while maintaining temperature distribution of various engine parts at an appropriate condition.

The production method of the above-described cylinder block 10 will be discussed. Firstly, a plurality of the reinforcement plate members 22 which have been already produced are inserted in predetermined positions to form a shell mold (not shown) or the like. Thereafter, molten metal of aluminum alloy or the like is poured into the mold so as to obtain the casting of the cylinder block 10. Accordingly, the opposite side wall sections 14*a*, 14*b* are securely connected with the central cylinder-barrel structure 22 by the reinforcement plate members 22 as shown in FIGS. 3 and 4. In order to accomplish inserting the reinforcement plate members 22, slits are formed at a metal die (not shown) corresponding to the water jacket 16, and the shell mold is formed upon inserting the reinforcement plate members 22 into the slits, the metal die corresponding to the water jacket 16 being drawn out after pouring the molten metal. This facilitates the proper location of the reinforcement plate members 22. In such casting of the cylinder block 10, it is preferable that the reinforcement plate members 22 are plated with metal materials, such as zinc, liable to be familiar with the material, such as aluminum alloy, of the cylinder block 10, thereby making complete the pouring of the molten metal while exhibiting rust-preventing and anticorrosion effect.

As appreciated from the above, according to the present invention, the cylinder block outer walls are securely connected with the centrally located cylinder-barrel structure by means of the reinforcement plate members each of which traverses the cylinder-barrel structure and is embedded in the side wall sections of the water jacket outer wall structure. Therefore, the rigidity of the water jacket outer wall structure is greatly improved, thereby decreasing lateral or open-and-close movement vibration of the outer wall structure while noticeably improving the tortional rigidity of the entire cylinder block. This effectively reduces total engine noise. Additionally, since the water jacket outer wall structure can be suppressed in its movement, the head gasket interposed between the cylinder head and cylinder block is effectively guarded from its damage or breakage.

What is claimed is:

1. A cylinder block comprising:

a cylinder-barrel structure having a plurality of cylinder barrels, neighboring cylinder barrels of said cylinder-barrel structure being integrally connected with each other at a connecting section formed therebetween;

a water jacket outer wall structure disposed spaced from said cylinder-barrel structure to define therebetween a water jacket, said outer wall structure being fully spaced from said cylinder-barrel structure at the top surface of said cylinder block onto which top surface a cylinder head is to be secured, said outer wall structure including first and second side wall sections which are located opposite to one another, said cylinder-barrel structure being interposed therebetween; and a reinforcement member disposed to rigidly connect said first and second side wall sections of said water jacket outer wall structure in a manner to traverse said cylinder-barrel structure, said reinforcement member extending from said first side wall section to said second side wall section and being connected to said cylinder-barrel structure only at the connecting section, said reinforcement member having a first end section embedded in said first side wall section and a second end section embedded in said second side wall section.

2. A cylinder block as claimed in claim 1, wherein the neighboring cylinder barrels of said cylinder-barrel structure are integrally connected with each other at a connecting section formed therebetween.

3. A cylinder block as claimed in claim 2, wherein said reinforcement member is of the plate type and located parallelly with the axis of said cylinder barrel.

4. A cylinder block as claimed in claim 3, wherein said reinforcement member has a vertically elongate central section located in said connecting section of said cylinder-barrel structure, and first and second vertically elongate end sections located in first and second side wall sections of said water jacket outer wall structure, respectively.

5. A cylinder block as claimed in claim 4, wherein said reinforcement member has first and second vertically elongate intermediate sections, said first intermediate section being positioned between said first end section and said central section, said second intermediate section being positioned between said second end section and said central section, said first and second intermediate sections being disposed within said water jacket.

6. A cylinder block as claimed in claim 5, wherein said first and second end sections of said reinforcement member have first and second bent edge portions, respectively, which project in generally opposite directions with respect to said central section.

7. A cylinder block as claimed in claim 6, wherein said reinforcement member is formed at said central section with at least an opening filled with the material of said cylinder block, and at each second intermediate section with at least an opening through which coolant in said water jacket passes.

8. A cylinder block as claimed in claim 1, wherein said cylinder block is made of aluminum alloy, in which said reinforcement member is plated with zinc.

9. A cylinder block as claimed in claim 1, wherein said reinforcement member is disposed in position by inserting it during casting of said cylinder block.

10. A cylinder block as claimed in claim 1, wherein said water jacket is formed by drawing out a die corresponding to said water jacket in the direction of the axis of each cylinder barrel through the top surface of said cylinder block during the casting of said cylinder block.

11. A cylinder block comprising:

a cylinder-barrel structure having a plurality of cylinder barrels, the neighboring cylinder barrels of said cylinder-barrel structure being integrally connected with each other at a connecting section formed therebetween;

a water jacket outer wall structure disposed spaced from said cylinder-barrel structure to define therebetween a water jacket, said outer wall structure being fully spaced from said cylinder-barrel structure at the top surface of said cylinder block onto which top surface a cylinder head is to be secured, said outer wall structure including first and second side wall sections which are located opposite to one another, said cylinder-barrel structure being interposed therebetween; and a reinforcement member made of a metal and disposed to rigidly connect said first and second side wall sections of said water jacket outer wall structure in a manner to traverse said cylinder-barrel structure, said reinforcement member having first and second end portions which are respectively embedded in said first and second side wall sections of said water jacket outer wall structure, said reinforcement member extending in a manner to pass through said cylinder barrel-structure connecting section.

* * * * *